United States Patent [19]

Thimon

[11] Patent Number: 4,473,990

[45] Date of Patent: Oct. 2, 1984

[54] MACHINE FOR PACKING A LOAD IN A SECTION OF SHEATH MADE OF SUPPLE MATERIAL SUCH AS A FILM OF PLASTICS MATERIAL

[75] Inventor: Jacques Thimon, Tresserve, France

[73] Assignee: S.A. Thimon, Aix-les-Bains, France

[21] Appl. No.: 225,335

[22] Filed: Jan. 15, 1981

[30] Foreign Application Priority Data

Jan. 17, 1980 [FR] France ..... 80 00980

[51] Int. Cl.[3] ..... B65B 9/14

[52] U.S. Cl. ..... 53/567

[58] Field of Search ..... 53/576, 563, 567, 585, 53/557, 556, 137, 128

[56] References Cited

U.S. PATENT DOCUMENTS

| | | | |
|---|---|---|---|
| 3,897,674 | 8/1975 | Higgins | 53/567 X |
| 3,902,303 | 9/1975 | King | 53/556 |
| 4,023,238 | 5/1977 | Phares | 53/567 X |
| 4,050,219 | 9/1977 | Higgins | 53/567 |
| 4,309,861 | 1/1982 | Karpisek | 53/567 X |
| 4,338,768 | 7/1982 | Ballestrazzi et al. | 53/137 X |

FOREIGN PATENT DOCUMENTS

| | | | |
|---|---|---|---|
| 2249225 | 4/1974 | Fed. Rep. of Germany | 53/567 |
| 2230549 | 12/1974 | France | 53/567 |

*Primary Examiner*—Horace M. Culver

*Attorney, Agent, or Firm*—McAulay, Fields, Fisher, Goldstein & Nissen

[57] ABSTRACT

A machine for packing a load in a section of sheath made of supple material, and particularly of plastic material, comprises mechanisms for supplying flat sections of sheath in the direction of the load and for opening the downstream end of each section of sheath opposite the load, and a pleating device for progressively pleating part of each section of sheath. The pleating device has rotatable pleating members applied against the sheath and against support ramps located inside the sheath. A movable covering frame whose section is larger than the cross section of the load to be packed is provided for bearing the section of pleated sheath. The rotatable pleating members are mounted on a support independent of the covering frame and the pleating device comprises mobile pleating arms. The arms are introduced inside the section of sheath and for applying them against the pleating members so as to serve as inner supports for the latter during the pleating operation, and for retracting these arms, after the pleating operation, so as to allow the displacement of the covering frame.

24 Claims, 27 Drawing Figures

MACHINE FOR PACKING A LOAD IN A SECTION OF SHEATH MADE OF SUPPLE MATERIAL SUCH AS A FILM OF PLASTICS MATERIAL

BACKGROUND OF THE INVENTION

The present invention relates to a machine for packing a load in a section of sheath made of a supple material such as a film of plastics material.

A machine for packing a load in a section of sheath meade of supple material, particularly a film of plastic material, is already known, which comprises a covering frame of larger section than the cross section of the load to be packed and a pleating device associated with the covering frame for progressively pleating a section of the sheath engaged on this frame, a magazine in which the section of pleated sheath is kept and means for displacing the covering frame and the vertical magazine along the load in order to surround this latter with the section of pleated sheath accumulated in the magazine and unpleated automatically in the course of this movement. Such a packing machine is described in French Pat. No. 73 18756 filed on May 23, 1973.

SUMMARY OF THE INVENTION

The present invention relates more particularly to improvements to a machine of this type with a view to facilitating the formation of the pleats and the displacement of the covering frame itself along the load to be packed.

To this end, this machine for packing a load in a section of sheath made of supple material, and particularly of plastics material, comprises means for supplying flat sections of sheath in the direction of the load, means for opening the downstream end of each section of sheath opposite the load, a pleating device for progressively pleating part of each section of sheath, which device includes rotating pleating members applied against the sheath and against support ramps located inside the sheath, a covering frame whose section is larger than the cross section of the load to be packed and bearing the section of pleated sheath and means for displacing the covering frame along the load in order to unpleat the section of sheath automatically in the course of this movement and deposit it around the load, the rotatable pleating members being mounted on a support independent of the covering frame. The pleating device comprises mobile pleating arms and means for introducing these arms inside the section of sheath and for applying them against the pleating members so as to serve as inner supports for the matter during the pleating operation, and for retracting these arms, outside the pleating operation, so as to allow the displacement of the covering frame.

The support of the pleating members may be fixed on the frame of the machine and the covering frame is then displaced as the pleats are made.

According to a preferred embodiment, the support of the pleating members is mobile with respect to the pleating arms bearing the support ramps for the pleating members and which are fixed during the pleating operation. In this case, the pleating arms each present a stop adapted to immobilise the downstream end of the section of sheath during the formation of the pleats. This embodiment enables the pleats to be formed completely independently, during the evacuation of a previously packed load, hence a considerable increase in the rate of functioning.

The machine according to the invention may be used for depositing a simple sleeve around the load, over the whole or part thereof, or for covering the load with a complete cover, i.e. having a transverse end obtained by closing the sheath.

The machine according to the invention offers the advantage that it makes it possible to control the opening and holding of the sheath, this ensuring for example a covering without there being any contact between the sheath itself and the load at the moment when this sheath is deposited. In addition, the load is entirely protected since the elements constituting the covering frame form a screen. Furthermore, it is possible, when the section of sheath, which can form a cover, is pleated before it is deposited on the load, to perform any function inside this section of sheath. In particular, a label may be deposited by means of a mobile member beneath the top of the cover. This operation is easy since, in the pleated state, a cover, even of large dimensions, is only of small height.

This machine according to the invention enables any supple material to be used for packing, and particularly nonretractable, retractable or stretchable, micro- or macro-perforated, thin or thick plastics films. Advantageously it allows the use of thin films having a thickness smaller than or equal to 60 microns which cannot be used with current machines provided with mobile clamps. The machine may also use other materials such as woven or non-woven materials, complexes of all types, nets, textile materials, etc. . . . The sheath used may be a sheath with gussets, a simple flat sheath, a film folded on itself, of which the two free ends are previously welded together, or flat films welded together to form a sheath.

The cross section of the load to be packed may be of any type: it suffices to adapt the covering frame for depositing the section of sheath, to the section of the load.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
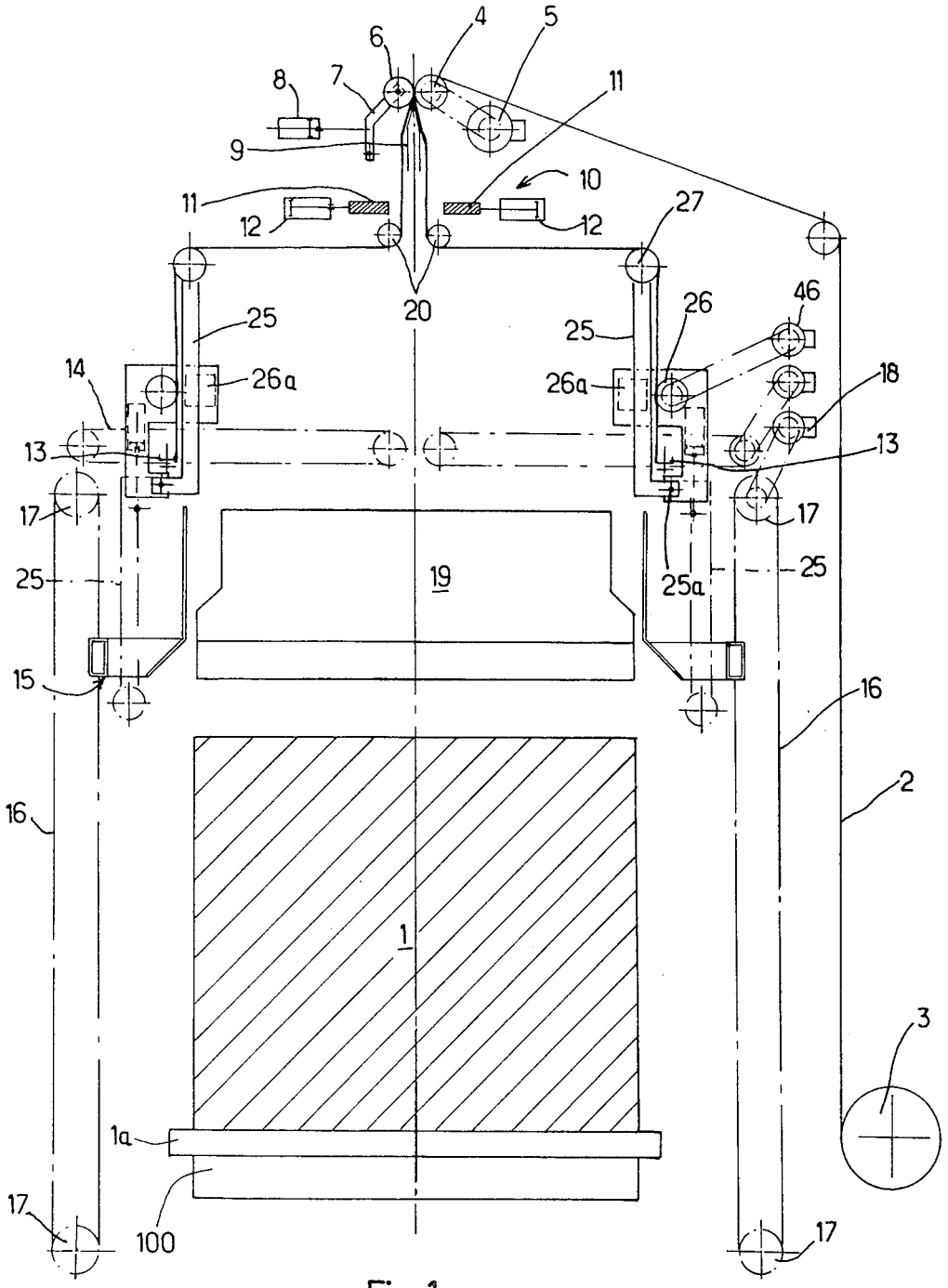
FIG. 1 is a schematic view in vertical section of a packing machine according to the invention.

Referring now to the drawings, the packing machine according to the invention which is shown schematically in FIG 1 comprises a frame, inside which the load to be packed is brought.

This load may be constituted by a stack of articles placed on a pallet 1*a*, itself displaced by a horizontal conveyor 100, perpendicularly to the plane of FIG. 1. The load 1 is packed by means of a sheet 2 of a packing material which is unwound from a reel 3 of horizontal axis, placed near the ground aside the machine or at the top of the frame of said machine. The sheet 2 of packing material may be constituted by any supple material such as a film of plastic material, this film being either retractable, or non-retractable, or stretchable, micro- or macro-perforated, thin (whose thickness is less than 60 microns) or thick (thickness more than 200 microns). The sheet 2 may also be constituted by a woven or non-woven material, a complex of any nature, a net, a textile material, etc; . . . The sheet 2 may be in different forms, for example a sheath with gussets, a flat sheath, a film folded on itself, or a flat film.

The use of the machine according to the invention for covering the load 1, i.e. the positioning thereon a cover closed at the top, from the top, will be considered in the following description. However, the machine may also be used for wrapping the load 1, i.e. for depositing a sleeve over all or part of the height of the load 1. This load may have a horizontal section of any form: rectangular, square, circular, hexagonal, octogonal, etc. . . .

In the example illustrated in the drawing, the sheet of packing material 2 is constituted by a sheath with gussets which passes, at the top of the machine, between a drive roller 4 of horizontal axis, driven in rotation by a motor 5, and a presser roller 6 on a horizontal axis parallel to that of the roller 4. This roller 6 is mounted on a lever 7 articulated about a horizontal axis and may be pressed against the drive roller 4 under the control of a jack 8. From the rollers 4 and 6, the gusseted sheath 2 descends and comes to a vertical separator 9 which is composed of two elements disposed laterally and engaging in the gap between each pair of lateral pleats of the sheath, so as to separate these two pleats slightly from one another. Below the separator 9 is located a welding and cutting device generally designated 10, of any known type, which essentially comprises two welding jaws 11, horizontally mobile under the control of jacks 12 located on either side of the vertical path followed by the slightly open sheath 2.

Although a welding device is preferably used for forming the cover, other means may also be used to this end, for example heat-sealing, seaming, gluing, clipping, etc. . . .

Below the welding and cutting device 10, the slightly open sheath 2 passes between two guide rollers 20 of horizontal axes, below which is located a device for opening the sheath. This opening device may be made according to different known means, employing, for example, suction members or clamps adhering to or gripping the four corners or pleats of the sheath. The drawing schematically shows clamps in FIGS. 1 and 13 which are mobile and borne by endless chains 14 driven by a motor. These clamps may grip the four corners of the slightly open sheath at their lower ends and move these four corners apart to make a "tent roof" opening as illustrated in FIG. 10B.

Figures 10A, 10B, 10C, 10D, 10E, 10F, 10G:
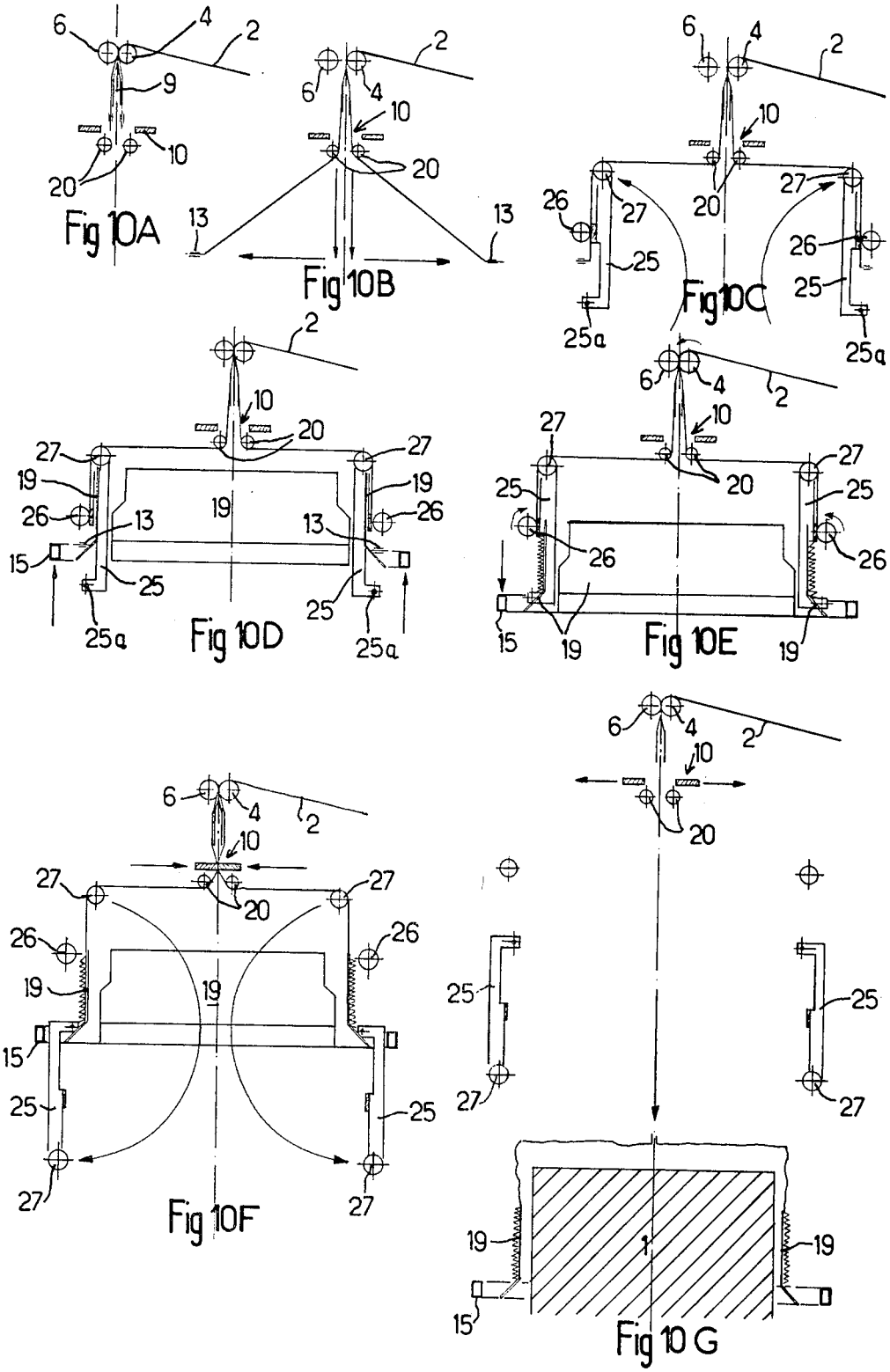
FIGS. 10A, 10B, 10C, 10D, 10E, 10F, 10G are diagrams illustrating the different phases of packing of a load by means of a pleated cover.
Figure 13:
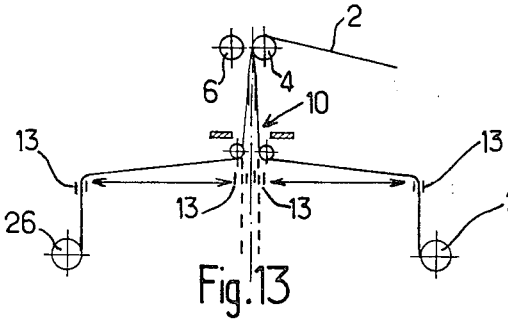
FIG. 13 is a diagram illustrating a variant of the opening mechanism wherein the clamps move only horizontally.

The clamps 13 may have a combined horizontal and vertical movement as illustrated in FIG. 10B. These clamps may also have only a horizontal movement, as illustrated in FIG. 13. In this case, the clamps 13 grip the four corners of the gusseted sheath at a certain height above their lower ends hanging freely below the guide rollers 20.

Figure 2:
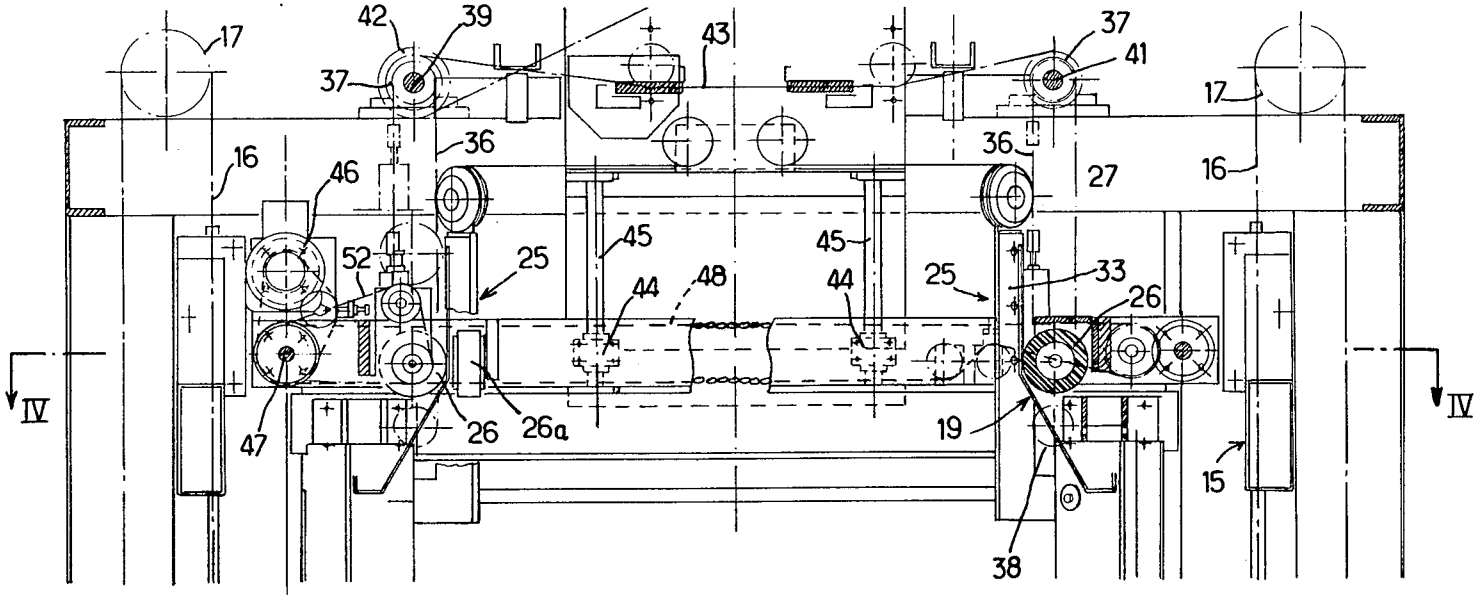
FIG. 2 is a view in vertical section, on a larger scale, of the top part of the machine, the covering frame being shown in raised position.
Figure 3:
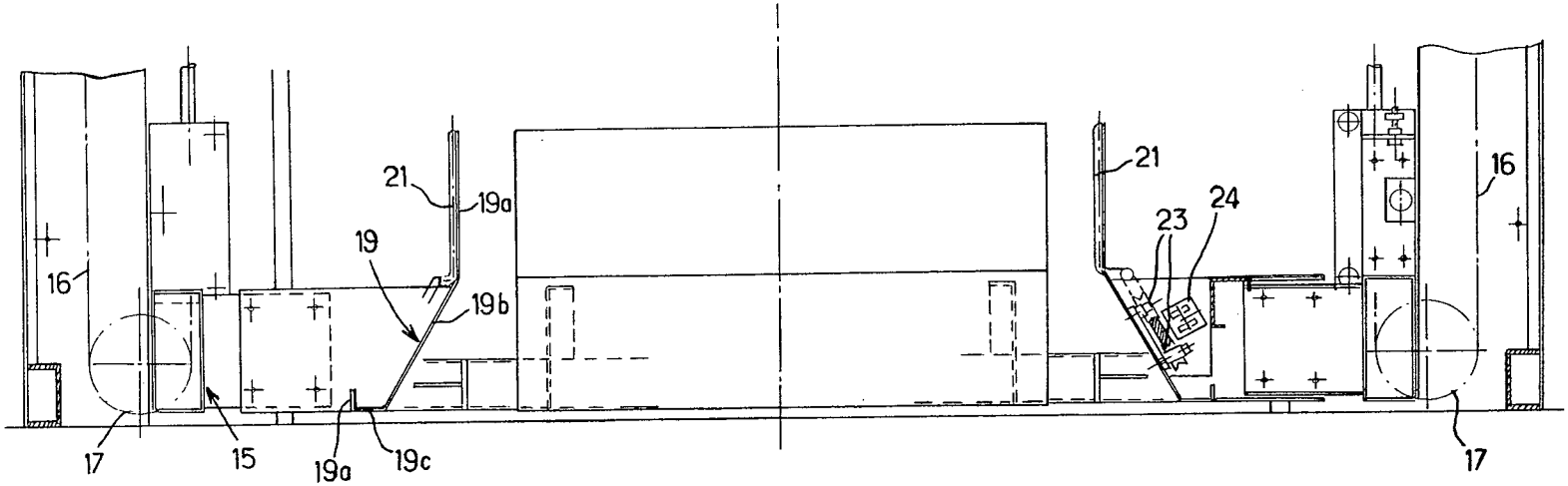
FIG. 3 is a view in vertical section of the bottom part of the machine, the covering frame being shown in lowered position.

Once the sheath is open, a certain length of the sheath is pleated. In a first embodiment of the machine according to the invention, this pleating operation may be carried out on a vertically movable covering frame 15. This covering frame 15 shown in extreme top position in FIG. 2 and in extreme bottom position in FIG. 3 is in an intermediate position in FIG. 1. The vertical movement of the covering frame 15 is ensured by four vertical endless chains 16 disposed respectively near the four corners of the frame and connected thereto. These chains 16 pass at the top and bottom over chain wheels 17 articulated about parallel horizontal axes, these chain wheels being coupled together by a transmission mechanism (not shown in detail). The movement of the chains 16 and consequently of the covering frame 15 is controlled by a motor 18 coupled to these chains.

Figure 5:
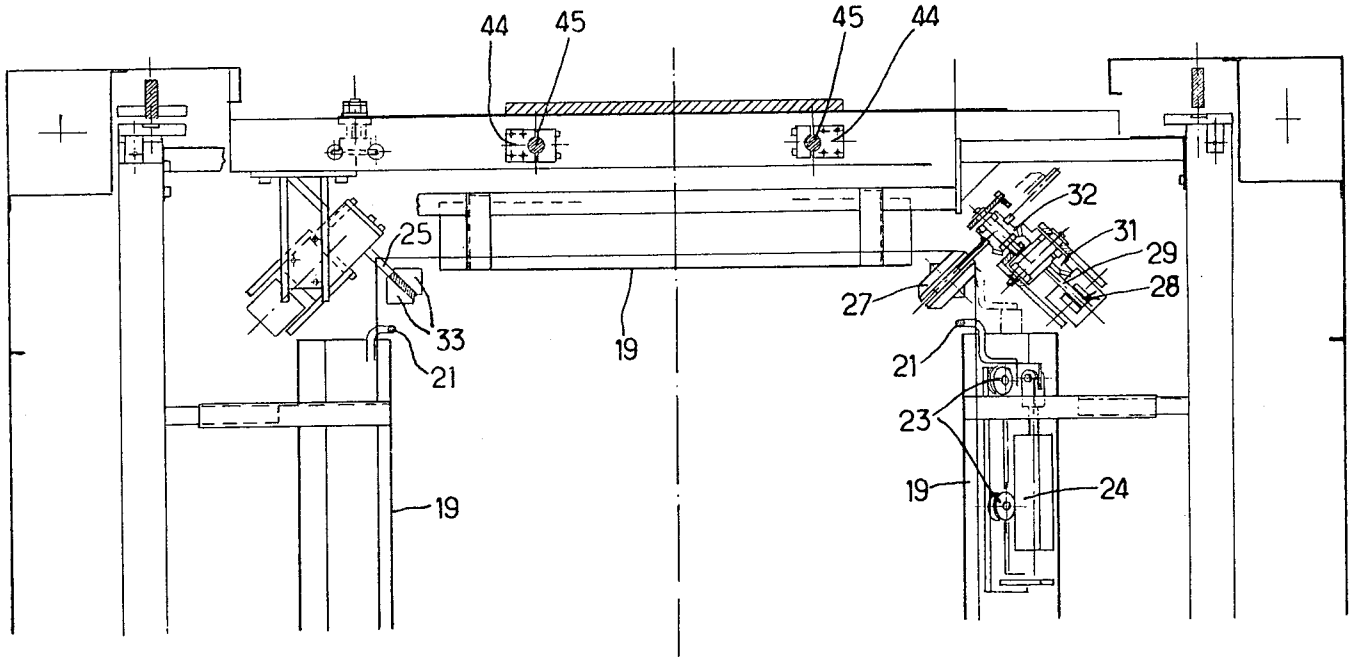
FIG. 5 is a view in partial horizontal section similar to that of FIG. 4, the pleating rollers and their drive mechanisms not being shown.

As may be seen in FIGS. 1 and 5, the covering frame 15 comprises a template constituted by four sectioned support plates 19 which are disposed in a rectangle, but leaving free spaces therebetween in the corners of this rectangle. These support plates 19 are preferably mounted to be adjustable in position horizontally with respect to the outer frame 15, so as to enable them to be adapted to the horizontal section of the load to be packed. The support plates 19 may be fixed on the frame 15 or, as will be seen hereinafter, articulated about horizontal axes at the bottom.

Figure 6:
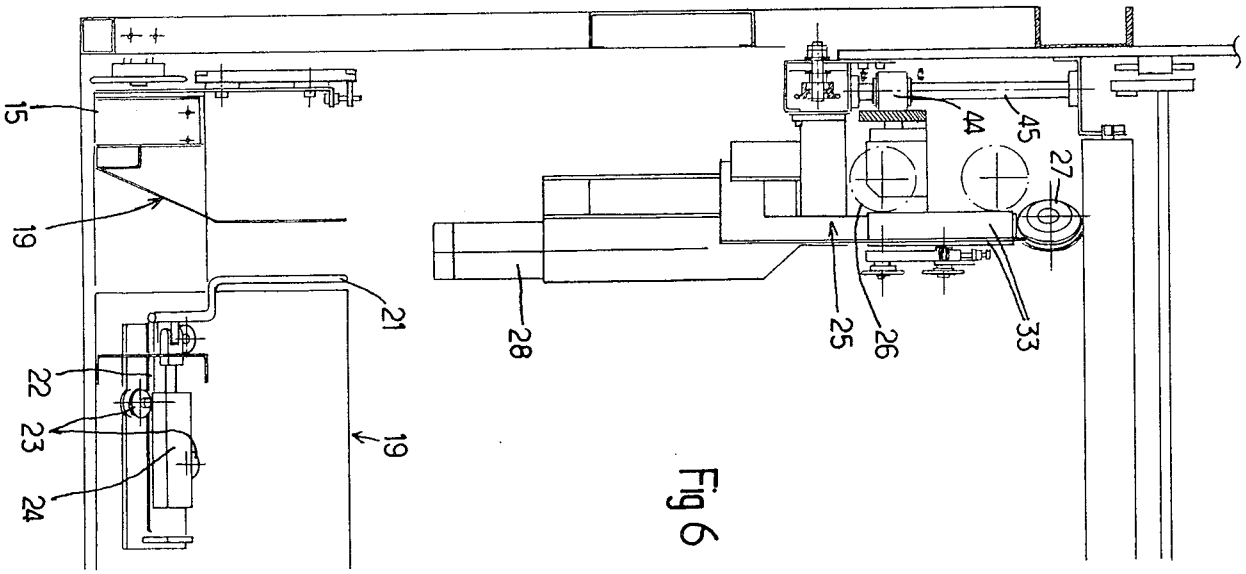
FIG. 6 is a view in partial vertical section, on a larger scale, of the left-hand part of the machine, the pleating arm being shown in top position and the covering frame being in extreme lower position.

Each support plate 19 preferably has a cross section, in vertical and transverse section, comprising a vertical upper flange 19*a* (FIG. 3) which terminates at its bottom end by a downwardly and outwardly inclined ramp 19*b* which itself extends outwardly into horizontal flange 19*c* and terminates by an edge 19*d* turned upwardly at right angles thereto. Two parallel, opposite support plates 19 each bear, at their two ends, two vertical fingers 21 for supporting the cover, which are adapted to engage inside the four corners of the pleated cover. Each of the support fingers 21 is fast with a horizontal rod 22 which is mounted to slide on the support plate 19 which bears it, via rollers 23. The rod 22 FIG. 6 is itself fast with the rod of a horizontal jack 24 mounted on the support plate 19.

Figure 9:
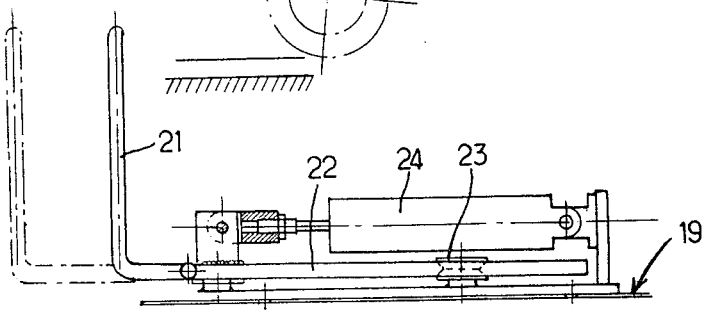
FIG. 9 is a view in elevation of a support finger and its control mechanism.

Depending on whether or not the jack 24 is fed by its bottom, the associated support finger 21 occupies a retracted position, shown in solid lines in FIGS. 5 and 9, or a projecting position shown in dashed and dotted lines in these Figures. In this latter position, each finger 21 is firmly engaged inside a corner of the pleated cover.

The machine further comprises a pleating device composed of four pleating arms 25 disposed in the four corners of the frame of the machine and with which four pairs of pleating rollers 26, 26*a* cooperate. Each of the pleating arms 25 is mounted movably so as to be able to occupy either a top vertical position, in which the arm 25 extends upwardly, as shown in solid lines in FIG. 1, which position it occupies during the operation for pleating the cover, or a lower position indicated in dashed and dotted lines. Each pleating arm 25 bears at its end a roller 27 which thus engages inside the cover, in a corner thereof, when the pleating arm 25 is in top vertical position.

In their lower position, the arms 25 are retracted laterally and outwardly to allow the frame 15 bearing the pleated cover to descend.

The movement of the pleating arm 25 allowing it to pass from its top position to its lower position may be a pivoting movement as shown in the drawing or a vertical and horizontal transfer movement.

In the non-limiting embodiment shown in the drawing, each arm 25 is mounted to pivot about a horizontal axis 25*a* which is perpendicular to the bisector of the angle of the rectangle formed by the support plates 19 of the cover frame 15. In other words, each of the pleating arms 25 pivots in a vertical plane which is a bisector plane of the dihedron formed by two adjacent lateral faces of the pleated cover.

In top vertical position, this arm 25 extends plumb with the empty space left between the two ends of two adjacent, perpendicular support plates 19, as may be seen more clearly in FIG. 5.

Figure 7:
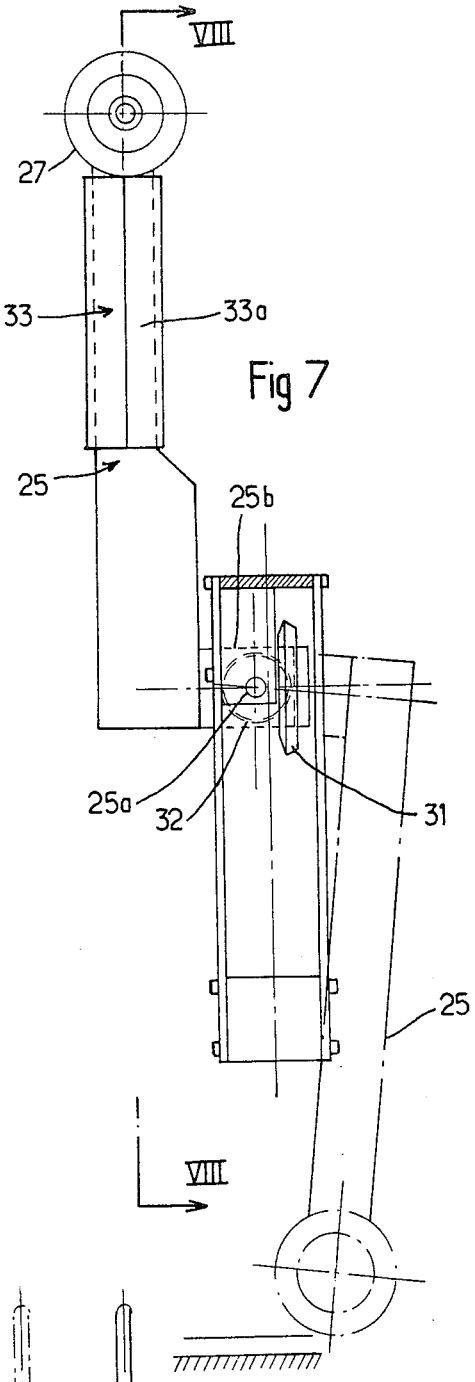
FIG. 7 is a view in elevation of a pleating arm and its control mechanism.
Figure 8:
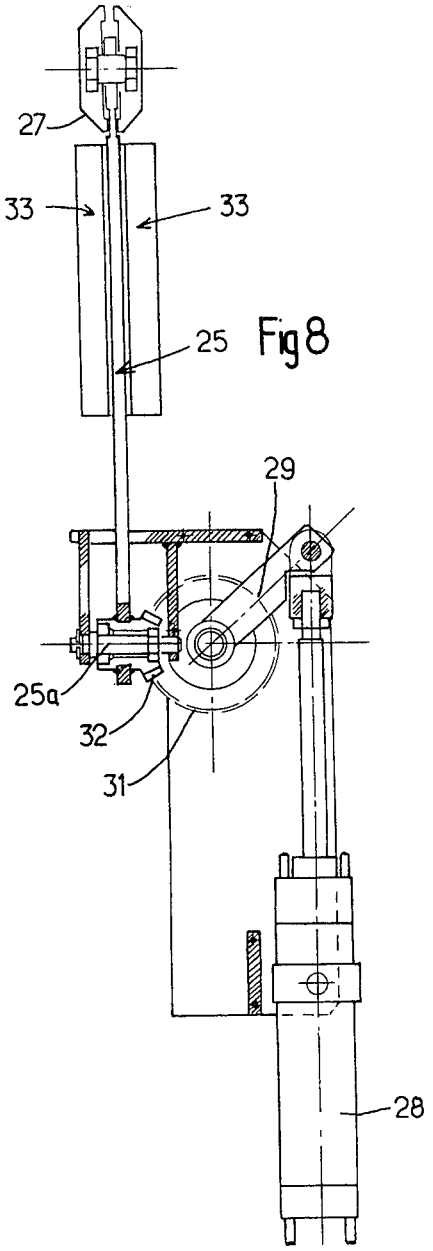
FIG. 8 is a view in vertical section along line VIII—VIII of FIG. 7.

The mechanism controlling the pivoting of each of the pleating arms 25 is shown more particularly in FIGS. 5, 7 and 8. This mechanism comprises a vertical jack 28 articulated about a horizontal axis at its bottom and whose upwarding extending rod is coupled to an arm 29 fast with a bevel gear 31 in mesh with another bevel gear 32. This gear is fast with a radial arm 25*b* extending at right angles with respect to the pleating arm 25, this radial arm 25*b* being articulated about the horizontal axis 25*a*.

It is seen from the foregoing description that the feeding of the jack 28 through its upper end provokes the return of its push rod and via the train of bevel gears 31, 32, the pivoting of the pleating arm 25 from its top vertical position to its lower position. In this lower position, indicated in dashed and dotted lines in FIGS. 1 and 7, the arm 25 is also shifted laterally outwardly.

Figure 4:
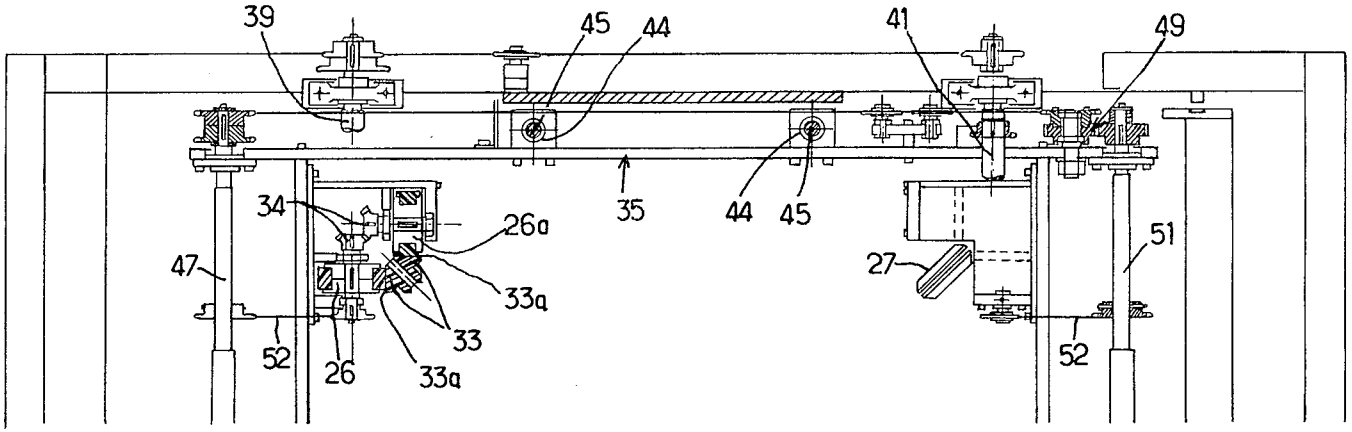
FIG. 4 is a view in partial horizontal section taken along line IV—IV of FIG. 2.

Each pleating arm 25 has, below the roller 27 (when the arm extends vertically upwardly), two pleating ramps 33 made of a material with a low coefficient of friction, for example made of plastics. Each of the two pleating ramps 33 has a cross section in the form of a right-angled isosceles triangle (FIG. 5) and they are fixed on the arm 25 in the form of a bar of rectangular section, on either side of this arm so that the whole has a substantially square or rectangular section. The two pleating ramps 33 include two perpendicular support faces 33*a* with which the pleating rollers 26 and 26*a* are in contact. Each of these rollers has, on its periphery, a layer of considerable roughness so that the film of plastics material is well fastened. The two pleating rollers 26, 26*a* which are disposed in each corner are rotatably mounted to about horizontal axes perpendicular to each other, and are coupled in each corner by a pair of bevel gears 34 (FIG. 4). The four pairs of pleating rollers 26, 26*a* are mounted in the four corners of a pleating frame 35 which may be fixed or vertically mobile as shown in the drawing. This pleating frame 35 is disposed above the covering frame 15 and its vertical movement is controlled by four vertical endless chains 36 which are fastened to the pleating frame 35 and which pass over upper chain wheels 37 and lower chain wheels 38 borne by the frame of the machine (FIG. 2). The two chain wheels 37 located in the left-hand part of the machine are coupled together by a horizontal shaft 39 and the same applies to the two chain wheels 37 located to the right which are coupled together by a horizontal shaft 41. Furthermore, one of these shafts, the left-hand shaft 39 in the present case, is rotated by an electric motor 42. The movement of rotation of this shaft 39 is transmitted by an endless chain 43 to the other shaft 41. Thus, the motion of the electric motor 42 in one direction or in the other causes the whole of the pleating frame 35 bearing the four pairs of pleating rollers 26, 26*a*, to rise or descend. To guide the frame 35, the latter is fast, on each of its sides, with a plurality of sleeves 44 which slide on vertical columns 45 fixed to the frame. Means are provided on the pleating frame 35 for rotating the various pleating rollers 26, 26*a* about their axis during the pleating operation. These means comprise an electric motor 46 which is borne by the pleating frame 35 and which rotates a horizontal shaft 47 extending on the left-hand side of the machine. This shaft 47 is coupled, at its two ends, via endless chains 48 passing over chain wheels, to gear trains 49 coupled to another horizontal shaft 51 extending to the right. Each of the shafts 47, 51 is in turn coupled at its two ends, via mechanisms with endless chain and chain wheels 52, to the pleating rollers 26 themselves coupled to the other pleating rollers 26*a* by the trains of bevel gears 34. In this way, the rotation of the motor 46 causes the concomitant rotation of all the pleating rollers 26, 26*a* borne by the pleating frame 35.

FIGS. 10C to 10G illustrate the manner in which the cover for packing the load 1 is made and deposited.

Once the "tent roof" opening of the sheath 2 is made by means of the clamps 13, as illustrated in FIG. 10B, the pleating arms 25 are introduced inside the sheath, to bring them into top vertical position as illustrated in FIG. 10C. To this end, the jacks 28 are fed through their lower end, this provoking a pivoting movement of the arms 25 about their axes 25*a*, these arms then engaging inside the sheath. At a certain moment in the course of the pivoting movement, the rollers 27 mounted at the ends of the arms 25 come into contact with the sheath and provoke a deformation thereof so as to draw it substantially horizontally between the rollers 27 and the pair of rollers 20 of horizontal axes located below the welding and cutting device 10.

At the end of the pivoting movement of the arms 25 in top vertical position, the pleating ramps 33 carried by these arms are applied by their outer faces 33*a* against the pleating rollers 26 and 26*a*, the film of plastics material constituting the sheath then being gripped between the rollers 26, 26*a* and the pleating ramps 33.

The upward movement of the covering frame 15 with its support plates 19 is then controlled, so as to bring it into its top position shown in FIGS. 2 and 10D. The vertical flanges 19*a* of the support plates 19 and the vertical support fingers 21 provided in the corners of the frame thus engage inside the sheath previously opened by the rollers 27 and gripped between the pleating rollers 26, 26*a* and the pleating ramps 33.

The actual pleating operation is then carried out. This operation may be carried out essentially in two different ways, depending on whether the pleats are formed on the covering frame 15 or on the pleating arms 25.

In a first embodiment, the pleating frame 35 bearing the pleating rollers 26. 26*a*, is fixed as shown in FIG. 10E and during the pleating operation the covering frame 15 is lowered. Simultaneously, the electric motor 46 is actuated in the appropriate direction so as to rotate all the pleating rollers 26, 26*a*. The latter then lower the open sheath, in the four corners, causing it to slide along the smooth outer faces 33*a* of the pleating ramps 33. The sheath 2 then forms pleats along the vertical flanges 19*a* of the covering frame, as indicated schematically in FIG. 10E, as the covering frame 15 moves downwardly. The downwardly and outwardly inclined parts 19*b* of the support plates 19 of the template then form a stop for immobilising the downstream end of the section of sheath in the course of pleating, which is indispensable for forming the pleats.

In a second embodiment of the invention which will be described hereinafter, the pleats are formed on the pleating arms 25 and the pleating frame 35 is preferably mobile upwardly during the pleating operation. This embodiment is preferable as it enables the pleats to be formed on the pleating arms 25 themselves, independently of the covering frame 15.

Once the appropriate length of sheath has been accumulated in the form of pleats on the covering frame, this length depending on the height of the cover finally having to be formed (in the case of the first embodiment of the invention), the sheath is welded and cut with the aid of the device 10 above the rollers 20, as shown in FIG. 10F.

At the same time as welding and cutting of the sheath, the pleating arms 25 are caused to retract downwardly, by pivoting in the direction of the arrows in FIG. 10F. The arms 25 then occupy a position in which they extend downwardly.

After the pleating arms 25 have been retracted into lower position, the four jacks 28 are fed at their lower end to extend the four support fingers 21, so that these fingers 21 press against the cover, from the inside to the outside, in the four corners of the cover.

The pleating arms 25 being retracted downwardly and laterally, and the support fingers 21 extended, the covering frame 15 on which the cover, whose lateral skirt is pleated, has been formed, is lowered. This lowering is illustrated in FIG. 10G. During this movement, the cover is totally free and when its top is applied against the top face of the load 1, it is immobilised by this load whilst the frame 15 continues to descend. Consequently, the pleats formed by the skirt of the cover are progressively removed and when the covering frame 15 reaches its lower end position, virtually at ground level, the whole cover is unfolded and covers all the load 1. At that moment, the support fingers 21 are returned into retracted position, by feeding the jacks 28 through their upper end.

Once the frame 15 is in lowered position, the load 1 covered with its cover may be removed and replaced by a fresh load to be packed. To control the stacking of the pleats appropriately, during the pleating operation, the covering frame 15 may be arranged to be lowered slowly, with respect to the pleating rollers 26, 26*a* remaining at the same horizontal level, in other words, the frame 35 remaining fixed.

Figure 11:
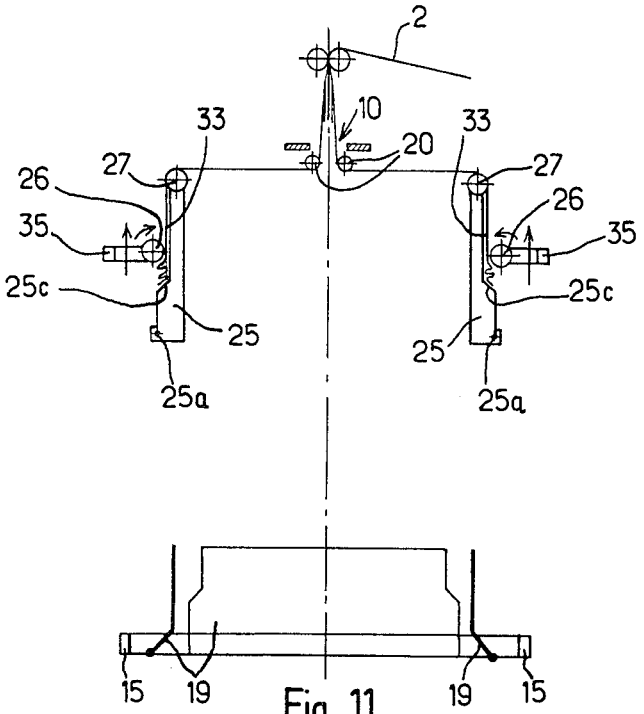
FIG. 11 is a diagram illustrating a variant embodiment in which the pleats are formed on pleating arms.

In the second embodiment of the invention, which has already been referred to hereinabove, the pleats of the section of sheath are formed on the pleating arms 25 themselves, as illustrated in FIG. 11, whilst the covering frame 15 is in lowered position. In this case, each pleating arm 25 is shaped so as to form a stop for the lower end of the section of sheath. This stop may be constituted, for example, by a downwardly and outwardly inclined ramp 25*c* when the arm 25 is in top vertical position (FIG. 7), this ramp connecting the relatively narrow upper part on which the pleating ramps 33 are provided, to the wider lower part. Once the arms 25 are engaged vertically inside the sheath (FIG. 11), a relative lowering of the pleating frame 35 bearing the pleating rollers 26, 26*a* and of the pleating arms 25 is caused. This relative displacement is preferably effected by a movement of the frame 25 with respect to the immobile pleating arms 25 but the reverse solution could also be envisaged. Consequently, the pleating frame 35 bearing the pleating rollers 26, 26*a* is slowly lifted, whilst rotating said rollers. To this end, the electric motor 42 is actuated so as to rotate the shafts 39 and 41 in the appropriate direction to cause the pleating frame 35 to rise slowly, whilst the pleating rollers 26, 26*a* are rotated along the pleating ramps 33. Thus, the rollers rise along the pleating ramps 33 as the pleats are formed and accumulated along the arms 25.

Once the pleats are formed on the arms 25, the covering frame 15 is raised so as to engage the template formed by the support plates 19 inside the section of pleated sheath, then the arms 25 are retracted downwardly and outwardly. From that moment, the situation is as illustrated in FIG. 10F; the section of pleated sheath is taken over by the covering frame 15 and may be deposited on the load during the descending movement of this frame.

This embodiment of the invention offers the advantage that it makes it possible to begin making the pleats of a cover intended for a fresh load whilst a previously packed load is being removed. An improduction rate is thus obtained, due to the fact that the pleats are formed independently from what occurs in the lower part of the machine.

According to a further embodiment, the support plates 19 may be eliminated and a simple covering frame 15 may be used, bearing, in the corners, the four vertical fingers 21 moved by the jacks 24. The pleats of the lateral skirt of the cover may then be formed on these four vertical fingers and along the pleating arms 25 in vertical position.

Figure 12A:
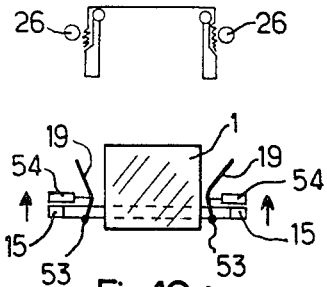
FIGS. 12A, 12B, and 12C are diagrams illustrating the functioning of a cover frame whose template is constituted by articulated plates.
Figure 12B:
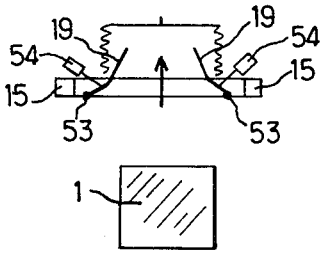
Figure 12C:
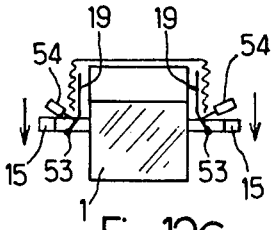

The support plates 19 fast with the covering frame 15 may be fixed or are preferably articulated in their lower parts, about horizontal axes 53 (FIGS. 12A–12C), so as to be able to pivot inwardly or outwardly. By pivoting them outwardly, for example, by means of jacks 54 borne by the covering frame 15 (FIG. 12A), these plates 19 are then spaced further from the load 1 to be packed, this facilitating the rise of the covering frame 15 along this load. On the contrary, at the end of the upward stroke of the covering frame 15, the plates 19 pivot inwardly under the control of the jacks 54 (FIG. 12B) to facilitate introduction thereof in the pleated sheath. Finally, during the covering operation, i.e. when the cover is being deposited on the load 1, the plates 19 occupy an intermediate position between the position pivoted outwardly and the position pivoted inwardly (FIG. 12C).

When the cover is made of thermo-retractable plastics, it is possible to use the support plates 19 for heating the plastics by means of a source of heat fast with the covering frame 15. To this end, any known heating means may be used, for example, electric heating elements incorporated in the support plates 19. The plates may also be provided to be heated from the outside. In this manner, it is possible to obtain a retraction of the plastics constituting the cover at the same time as the latter is deposited on the load 1.

The machine according to the invention enables cold-drawable films to be used for packing the load 1. By supplying hydraulic jacks, the elements of the covering frame 15 may be spaced apart from one another and if a sufficient effort is exerted by means of these jacks, an appreciable extension of the film forming the section of pleated sheath may be provoked, such extension being sufficient to allow the load 1 to be covered during the downward movement of the covering frame 16 and to encase this load in an elastically shortened drawable film.

Figure 14:
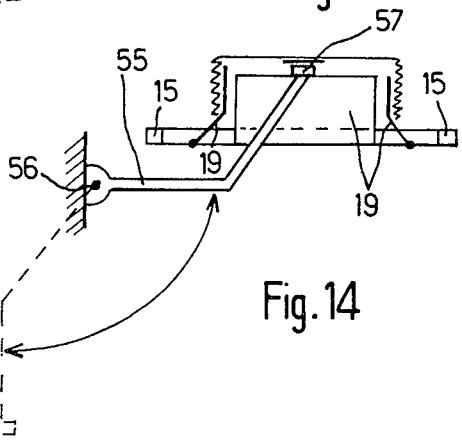
FIG. 14 is a diagram illustrating the placing of a label inside a section of pleated sheath, beneath the top of the cover.

FIG. 14 illustrates the positioning of a label, beneath the top of a cover formed at the top of the machine in the form of a section of pleated sheath. This positioning may be effected, for example, by means of an arm 55 pivoting about a horizontal axis 56 and moved by a suitable drive mechanism (not shown) arm 55 is shaped so as to engage upwardly in the section of pleated sheath and so that its mobile end 57, forming a pad for applying the label, is applied, at the end of the ascending stroke, beneath the top of the pleated cover to affix the label thereon. The application of a label is facilitated even with an unfolded cover of considerable height; the height of this cover is in fact much reduced when it is in the pleated state. In the same way, any other operation may also be carried out inside the pleated cover.

With reference to FIGS. 15 to 18, a modified embodiment of the device controlling the movement of the support plates 19 and the fingers 21 will now be described. In this embodiment, each vertical finger 21 is fast with a rod 61 fixed to a sleeve 62 mounted to pivot about a vertical axis. This sleeve is itself fast with a radial arm 63 which is pivoted, at its end, to the rod of the control jack 24. Energizing this jack 24 therefore causes pivoting about the vertical axis of the sleeve 62. This sleeve 62 is fast with a stop 64 constituted by a horizontal rib in the form of an arc of circle. With this stop 64 cooperates a catch 65 articulated about a horizontal axis 66. A vertical sensor 67 is pivoted, at its top end, on the catch 65, about an axis 68.

Figure 15:
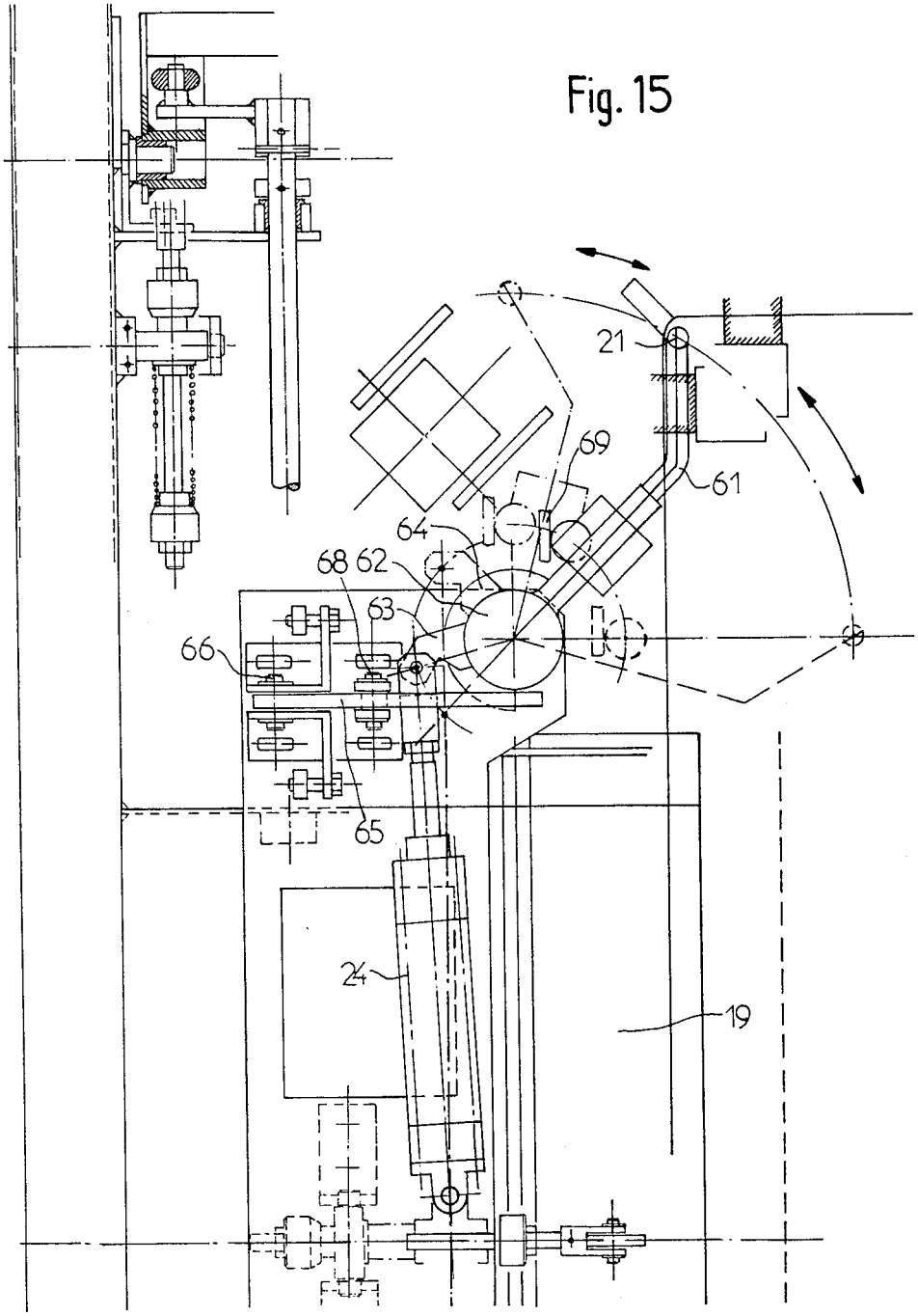
FIG. 15 is a partial plan view of a device for controlling the movement of the support fingers and the pivoting support plates.
Figure 16:
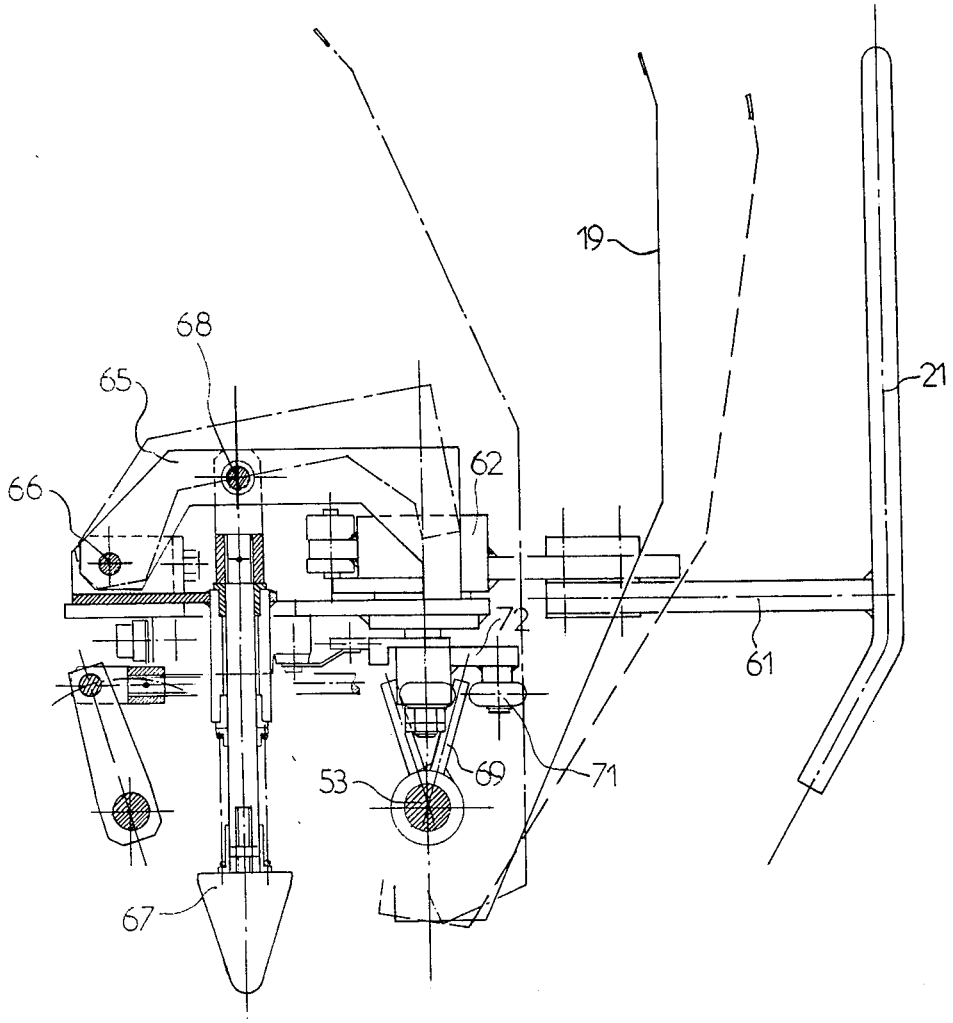
FIG. 16 is a view in vertical section along line XVI—XVI of FIG. 15.

Furthermore, the support plate 19 is fast with a horizontal shaft 53 constituting its axis of pivoting. A radial lug 69 is welded on this shaft 53. This lug on a roller 71 mounted on a radial arm 72 rotating with the sleeve 62. The functioning of the device which has just been described is as follows:

In FIGS. 15 and 16, the main mobile pieces of the device are shown in solid lines in a first position that they occupy when the pleated sheath descends around the load, in dashed and dotted lines in a second position that they occupy during the lifting of the covering frame, and in dashed lines in a third position occupied when the pleated sheath is taken over.

Figure 17:
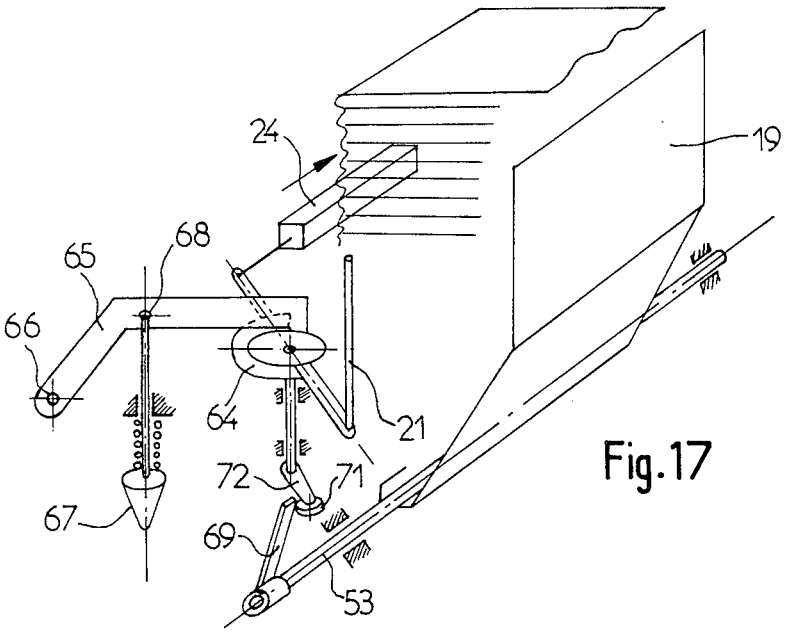
FIGS. 17, 18 and 19 are schematic views in perspective illustrating the functioning of the device shown in FIGS. 15 and 16.

During the lowering of the pleated sheath, the vertical fingers 21 are located inside this sheath as indicated in FIG. 17. In this position, each finger 21 is engaged in a corner of this sheath and its angular position, around its axis of rotation, is defined by the contact between the circular stop 64 and the downwardly curved end of the pivoting catch 65. In this position, the support plate 19 is substantially vertical but it may pivot freely about its axis, since the lug 69 is in abutment on the roller 71, under the sole action of the weight of the support plate 19 which is shifted inwardly with respect to its pivot axis.

During lowering of the covering frame, during which movement the pleated sheath is progressively unfolded so as to surround the load, the sheath is carried by the four vertical fingers 21 whilst the support plates 19 remain free between the sheath and the load, preventing any contact therebetween.

Figure 18:
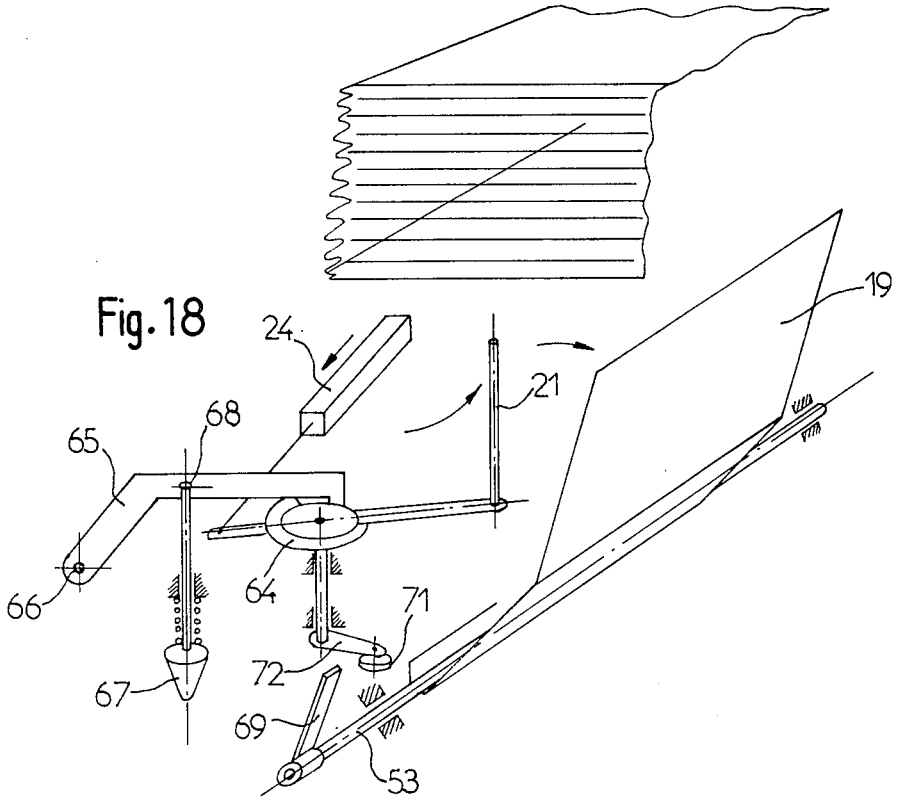
Figure 19:
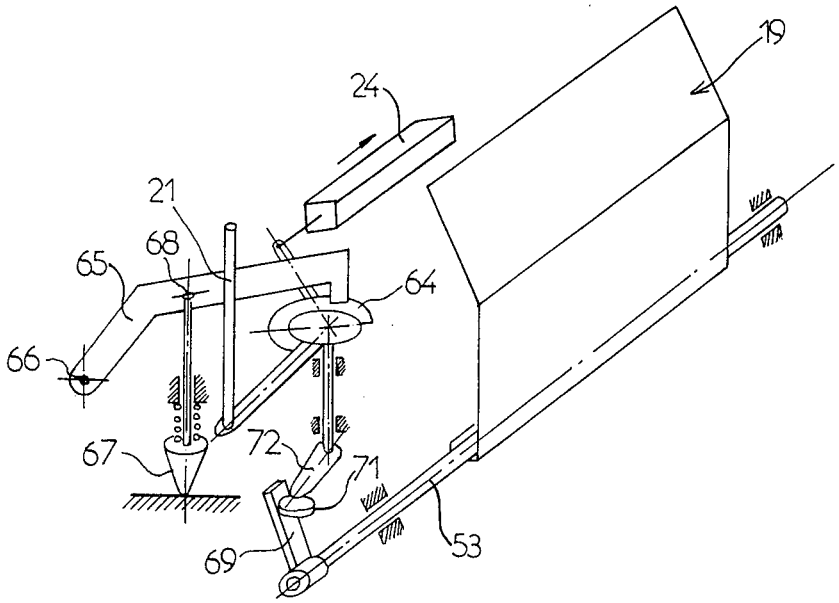

At the end of the descending stroke of the covering frame, the sensor 67 comes into contact with the ground (or with an adequate stop provided on the frame), which contact pivots the catch 65 about its axis 66 and to raise it. Consequently, the end of the catch 65 is disengaged from the circular stop 64 and as the jack 24 is always fed through its upper part, jack 24 rotates of the finger 21, which then pivots counterclockwise about its vertical axis. The finger 21 then occupies its second position shown in dashed and dotted lines in FIG. 15. The arm 72 and the roller 71 which it bears follow this movement so that the roller 71 provokes an outward rotation of the lug 69 and of the shaft 53, which has for its effect to pivot the support plate 19 in the second position or outer position shown in dashed and dotted lines. This position is shown in FIG. 18. When the covering frame rises, the sensor 67 is no longer in contact with the ground and the catch 65 is therefore released. However, it cannot return into locking position as its end then rests on the circular stop 64. During the upward movement of the frame, the fingers 21 and the support plates 19 thus remain in their second position or outer position illustrated in FIG. 18.

When the covering frame arrives at a level higher than that of the top of the palettized load, the jack 24 is fed through its bottom. The effect of this is that the sleeve 62 and the vertical finger 21 are pivoted through an angle of 90° in clockwise direction in FIG. 15. The finger 21 then occupies its third position shown in dashed lines. In the course of this of rotation, the catch 65 is able to drop into locking position, as soon as the front face of the circular stop 64 passed beyond the end of the catch. Furthermore, the arm 72 bearing the roller 71 has also pivoted through 90°, releasing the support plate 19 which may then pivot in its inner position shown in dashed lines. This third position or inner position corresponds to taking over the pleated sheath and in this position the four fingers 21 and the four supports plates 19 are clearly located inside the perimeter of the sheath.

When the covering frame arrives in its highest position, the jack 24 is fed through its upper part, which has for effect to pivot the finger 21 which passes from its inner position to its intermediate position in which it is in abutment in the corner of the sheath. The front face of the circular stop 64 meets the end of the catch 65, this limiting the pivoting movement of the finger 21 in counterclockwise direction. At the same time, the arm 72 and the roller 71 pivot in counterclockwise direction, up to their first position in which the roller 71 freely retains the lug 69. Consequently, the support plate 19 is free and is simply retained by the abutment of the lug 69 on the roller 71. Thus, in the course of the subsequent lowering, the support plate 19 can follow any irregularities of the horizontal section of the palettized load.

Although in the previously described embodiment the packing of the load 1 has been provided by means of a cover deposited vertically thereabove, the horizontal packing of long loads brought onto a receiving table may also be effected according to the invention. In this case, the covering frame bearing the pleated sheath is displaced horizontally from one end of the load (with its end covered first), towards the other end. In this case, the load is borne by a retractable support.

The machine according to the invention may be designed to function entirely automatically or for semi-automatic functioning with certain manual functions.

What I claim is:

1. A machine for packing a load in a section of sheath, comprising;

means for supplying flat sheaths to said load;

separator means for opening the front end of said sheath and separating said sheath into sections by and about said load;

a pleating device for progressively pleating part of each section with includes:

a covering frame shaped to fit about said load for supporting a pleated section of sheath, a support independent of said frame, support means adapted to fit inside said sheath;

rotatable pleating members mounted on said support and pressing said sheath and said support means;

mobile pleating arms and means for introducing said arms inside said section of sheath and for applying said arms against said pleating members and for retracting said arms after the pleating operation; and means for moving said frame along said load to unpleat said section during this movement and to position said section around said load.

2. The machine of claim 1, wherein said support for said pleating members is fixed on said frame and means are provided to displace such frame with respect to said pleating members as pleats are formed.

3. The machine of claim 2, wherein said support for said pleating members is movably mounted on said frame in the same direction as said covering frame and means are provided to displace said support with respect to said frame.

4. The machine of claim 3, wherein said means for displacing said support for said pleating members comprise an electric motor mounted on a frame and four vertical chains passing over chain wheels coupled together by horizontal shafts and a horizontal endless chain, said support for said pleating members being connected to said four endless chains and bearing sleeves slidably mounted on guide columns.

5. The machine of claim 1, having in each corner two pleating rollers mounted on perpendicular axes and coupled together by a pair of bevel gears, two plane faces abutting against said rollers and against pleating ramps borne by the associated pleating arm.

6. The machine of claim 5, wherein an electric motor for driving said pleating rollers is mounted on said support, said motor being coupled to the rollers of each pair of pleating rollers by a transmission mechanism.

7. The machine of claim 5, wherein each pleating arm is pivoted about an horizontal axis and is controlled by a jack thru a connecting mechanism for converting the translational movement of the rod of the jack into a rotational movement of said arm.

8. The machine of claim 7, wherein each pleating arm has a roller at its mobile end.

9. The machine of claim 7, wherein the pivoting axis of each arm is situated perpendicularly to the bisector of the angle formed by two adjacent sides of a rectangular load.

10. The machine of claim 7, wherein each pleating arm is formed by a bar having a rectangular section on the faces of which are fixed two pleating ramps made of plastic material, said ramps having a cross section in the form of a right-angled isosceles triangle.

11. A machine for packing a load in a section of sheath, comprising:

means for supplying flat sheaths to said load;

separator means for opening the front end of said sheath and separating said sheath into sections by and about said load;

a pleating device for progressively pleating part of each section which includes:

a covering frame shaped to fit about said load for supporting a pleated section of sheath, a support independent of said frame, support means adapted to fit inside said sheath;

rotatable pleating members mounted on said support and pressing said sheath and said support means;

mobile pleating arms and means for introducing said arms inside said section of sheath and for applying said arms against said pleating members and for retracting said arms after the pleating operation;

means for moving said frame along said load to unpleat said section during this movement and to position said section around said load; and means for causing a correlative translational movement parallel to the pleating arms between the pleating members and the pleating arms during formation of said pleats.

12. A machine for packing a load in a flexible sheath, comprising:

means for supplying flat sheath to said load;

separator means for opening the front end of said sheath and separating said sheath into sections by and about said load;

a pleating device for progressively pleating part of each section which includes:

a covering frame shaped to fit about said load for supporting a pleated section of sheath, a support independent of said frame; support means adapted to fit inside said sheath;

rotatable pleating members mounted on said support and pressing against said sheath and said support means;

mobile pleating arms and means for introducing said arms inside said section of sheath and for applying said arms against said pleating members and for retracting said arms after the pleating operation;

means for moving said frame along said load to unpleat said section during this movement and to position said section around said load, said machine having in each corner two pleating rollers mounted on perpendicular axes and coupled together by a pair of bevel gears, two plane faces abutting against said rollers and against pleating ramps borne by the associated pleating arm;

each of said pleating arm being pivoted above an horizontal axis and controlled by a jack through a connecting mechanism for converting the translational movement of the rod of the jack into a rotational movement of said arm;

each pleating arm having a relatively narrow end part and a relatively wide part near the pivoting axis thereof, said parts being connected by an outwardly inclined ramp and forming stops for the downstream end of said section of said sheath.

13. The machine of claim 12, wherein said covering frame bears in its four corners vertical support fingers, said fingers being horizontally mobile and connected to the rods of controlled jacks having horizontal axes and carried by the covering frame.

14. The machine of claim 13, wherein each of said vertical support fingers is fast with a horizontal rod guided by rollers mounted on said covering frame and connected to said rod of the control jack.

15. The machine of claim 12, wherein said covering frame comprises a template constituted by four support plates disposed in a rectangle, parallel to the respective sides of the frame, said four support plates not joining in the corners of the frame so as to leave free spaces therebetween for the passage of said pleating arms.

16. The machine of claim 15, wherein each of said support plates comprises an upper vertical flange extended at its lower end by a downwardly and outwardly inclined ramp, itself extended by a horizontal flange projecting outwardly and terminating into an edge turned upwardly at right angles thereto.

17. The machine of claim 15, wherein the said support plates are fixed on said covering frame.

18. The machine of claim 15, wherein said support plates are pivoted at their lower ends on horizontal axes and means are provided to pivot said plates whereby during ascent of said covering frame, about said load, said plates are pivoted outwardly and then inwardly when said template is introduced into the section of pleated sheath formed on said pleating arms and are returned to intermediate vertical position during the descent of said covering frame during which said section of sheath is deposited on said load.

19. The machine of claim 13, wherein said covering frame carries a jack including an actuating rod, said vertical finger being mounted to pivot about a vertical axis and controlled by said jack, a stop being movable with an arm fast with said finger, and a rotatable horizontal shaft integral with said support plate, a lug fixed on said shaft and bearing on said stop, said lug being applied freely under the urging of said support plate against said stop to define the inner limiting position of said support plate as a function of the limit position of said finger.

20. The machine of claim 14, wherein said vertical finger is fast with a sleeve mounted to pivot about the vertical axis thereof and to which is coupled the rod of said control jack, said sleeve being fast with a circular stop and having a horizontal pivoted catch, a vertical sensor articulated at its upper end on said catch so as to raise said catch and release said circular stop when said covering frame reaches its lower position.

21. The machine of claim 15, having means for heating said support plates.

22. The machine of claim 11, further including cutting and fastening means mounted above said separator means.

23. The combination of the machine of claim 11, of means for carrying out an additional operation inside said section of pleated sheath formed on said pleated arms.

24. The machine of claim 23, wherein said means is a label-affixing device.

* * * * *